US005270696A

United States Patent [19]

Shin et al.

[11] Patent Number: 5,270,696

[45] Date of Patent: Dec. 14, 1993

[54] LCD DRIVER CIRCUIT

[75] Inventors: Yasuhiro Shin; Teruyuki Fujii, both of Tokyo, Japan

[73] Assignee: Oki Electric Industry Co., Ltd., Tokyo, Japan

[21] Appl. No.: 857,637

[22] Filed: Mar. 25, 1992

[30] Foreign Application Priority Data

Mar. 29, 1991 [JP] Japan ..... 3-66777

[51] Int. Cl.[5] ..... G09G 5/00

[52] U.S. Cl. ..... 340/789; 340/784; 340/811

[58] Field of Search ..... 340/784, 789, 800, 801, 340/811, 805

[56] References Cited

U.S. PATENT DOCUMENTS

| | | | |
|---|---|---|---|
| 4,005,404 | 1/1977 | Soobik | 340/800 |
| 4,538,145 | 8/1985 | Mitani et al. | 340/802 |
| 4,799,057 | 1/1989 | Takeda et al. | 340/802 |
| 5,021,775 | 6/1991 | Babin | 340/802 |
| 5,047,759 | 9/1991 | Takebe et al. | 340/789 |
| 5,162,786 | 11/1992 | Fukuda | 340/784 |
| 5,164,970 | 11/1992 | Shin et al. | 340/811 |

FOREIGN PATENT DOCUMENTS

| | | | |
|---|---|---|---|
| 0244978 | 11/1987 | European Pat. Off. . | |
| 0163794 | 6/1990 | Japan | 340/800 |
| 233492 | 10/1991 | Japan . | |
| 3-233492 | 10/1991 | Japan . | |
| 2135099 | 8/1984 | United Kingdom . | |
| 2188183 | 9/1987 | United Kingdom . | |

OTHER PUBLICATIONS

IBM Technical Disclosure Bulletin Dec. 1988 "Sequence Detect Latch Trigger", pp. 90–92.

*Primary Examiner*—Richard Hjerpe
*Assistant Examiner*—Lun-Yi Lao
*Attorney, Agent, or Firm*—Spencer, Frank & Schneider

[57] ABSTRACT

Disclosed herein is an LCD driver circuit comprising a plurality of cascade-connected LCD drivers. The LCD driver circuit can be activated to make a latch pulse signal input thereto active on the trailing edge thereof and operated even if a corresponding clock pulse signal is input in confronting relationship during a period in which the latch pulse signal is being input. Each of the LCD drivers has a latch pulse control circuit for selecting either one of a first latch pulse signal and a second latch pulse signal generated corresponding to the first latch pulse signal in accordance with an enable signal input at the time the LCD drivers are cascaded, thereby controlling an enable latch circuit and a shift register.

21 Claims, 8 Drawing Sheets 100
200
500
132
133
136
232
233
236
532
533
536
T101
T102
T103
T104
T105
T201
T202
T203
T204
T205
T501
T502
T503
T504
T505
DS
CP
LP
10
20
30
DATA GENERATING CIRCUIT
CLOCK PULSE GENERATOR
LATCH PULSE GENERATING CIRCUIT

| |
|---|
| Fig. 3A |
| Fig. 3B |

LCD DRIVER CIRCUIT

CROSS REFERENCE TO RELATED

This application is related to copending U.S. Patent application Ser. No. 07/627,408, filed Dec. 14, 1990 and copending U.S. Patent application Ser. No. 07/825,384 filed Jan. 24, 1992 both of which have been assigned to the same assignee of the present patent application and are incorporated herein by references.

BACKGROUND OF THE INVENTION

The present invention relates to a driver circuit which can be cascade-connected to other driver circuits. More particularly, the present invention relates to a driver circuit used to drive a liquid crystal display (hereinafter abbreviated as "LCD") in particular and which has a circuit for latching therein large quantities of data fed in serial form and outputting the data in parallel therefrom.

As an LCD driver circuit is required to produce a number of outputs, it has a data latch circuit for converting serial data fed from a data generating circuit into parallel data.

The LCD driver circuit having the data latch circuit is normally constructed by a large IC having about 100 terminals. However, such an IC can handle a maximum of 80 outputs. On the other hand, where an IC has about 180 terminals formed by tape automated bonding (hereinafter abbreviated "TAB"), it can handle a maximum of 160 outputs.

Thus, where an electrically processing data system which processes about 640 bits of data is constructed, it is necessary to cascade-connect four to eight driver circuit ICs each of which has 80 to 160 outputs.

In a conventional LCD driver circuit which is cascade-connected to other LCD driver circuits, it is necessary to latch the last serial data based on a latch pulse LP after the last serial data has been transferred. The number of bits (BITS) of data increases in the order of 4, 8 and 12, for example, due to the fact that the screen of an LCD is formed on a large scale. In addition, a clock pulse CP used for the transfer of data also has an increased frequency ranging from 3 MHz through 6 MHz to 8 MHz. Correspondingly, the pulse width of the clock pulse CP becomes narrow. It is therefore necessary to decrease the pulse width of the latch pulse LP corresponding to that of the clock pulse CP. However, when the pulse width of the latch pulse LP is decreased, the present LCD driver circuit is liable to cause malfunctions. When the frequency of the clock pulse CP is 6 MHZ, the pulse width of the corresponding latch pulse LP is about 83 ns. When the frequency of the clock pulse CP is 9 MHZ, the pulse width of the corresponding latch pulse LP is about 62 ns. The pulse width of a latch pulse LP in actual use as an input to the proposed LCD driver circuit is about 50 ns. Thus, the LCD driver circuit is liable to cause malfunctions due to a reduced operating margin. This leads to a bottleneck when a large screen of an LCD is set up.

SUMMARY OF THE INVENTION

With the foregoing problems in view, it is an object of the present invention to provide a driver circuit cascade-connected to other driver circuits, which can be operated with a latch pulse having a wide pulse width. It is another object of the present invention to provide a driver circuit which is not liable to cause malfunctions.

According to one aspect of the present invention, there is provided an LCD driver circuit comprising a counter circuit for receiving the clock pulse and the latch pulse therein so as to output a first control signal therefrom, a latch pulse control circuit for receiving the first control signal and the latch pulse therein so as to output a second control signal therefrom, a clock control circuit for receiving the second control signal and the clock pulse therein so as to output a third control signal therefrom, a data transfer or address designation circuit for receiving the second and third control signals therein so as to output a plurality of fourth control signals therefrom, one of the fourth control signals being input to a clock control circuit, a data latch circuit for receiving the remaining fourth control signals and the serial data therein so as to output a plurality of data signals therefrom, and an output circuit for outputting drive signals therefrom based on the data signals.

The above and other objects, features and advantages of the present invention will become apparent from the following description and the appended claims, taken in conjunction with the accompanying drawings in which preferred embodiments of the present invention are shown by way of illustrative examples.

BRIEF DESCRIPTION OF THE DRAWINGS

FIGS. 2, 2A and 2B comprise a diagram showing a circuit configuration of an LCD driver circuit shown in FIG. 1;

DESCRIPTION OF THE PREFERRED EMBODIMENTS

An LCD driver circuit of the present invention will hereinafter be described in detail with reference to the accompanying drawings in which preferred embodiments are shown by way of illustrative examples.

Figures 1, 1A, 1B:
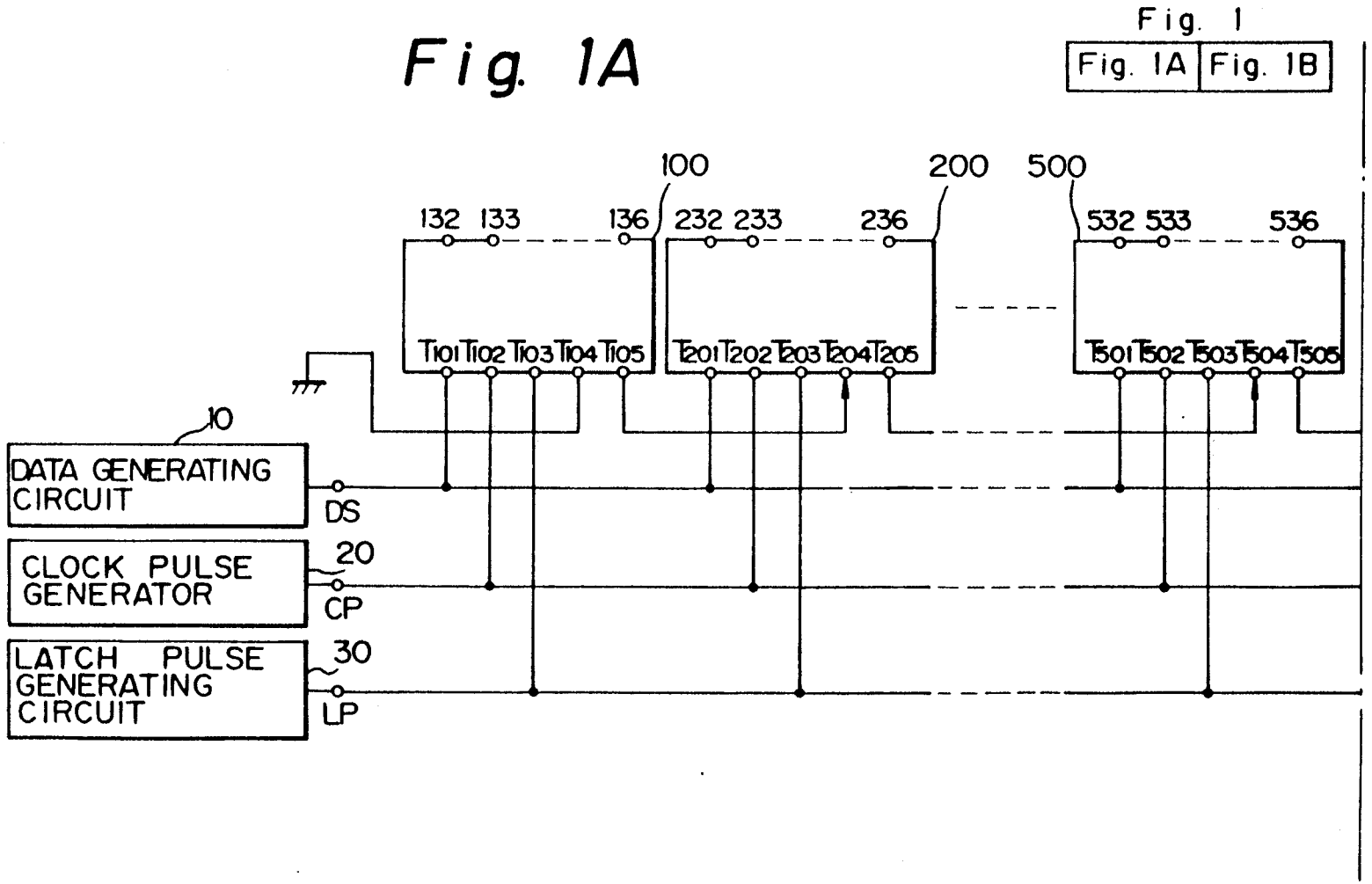
FIGS. 1, 1A and 1B comprise a diagram showing the cascade-connection relationship of a plurality of LCD driver circuits according to a first embodiment of the present invention.
Figure 1B:
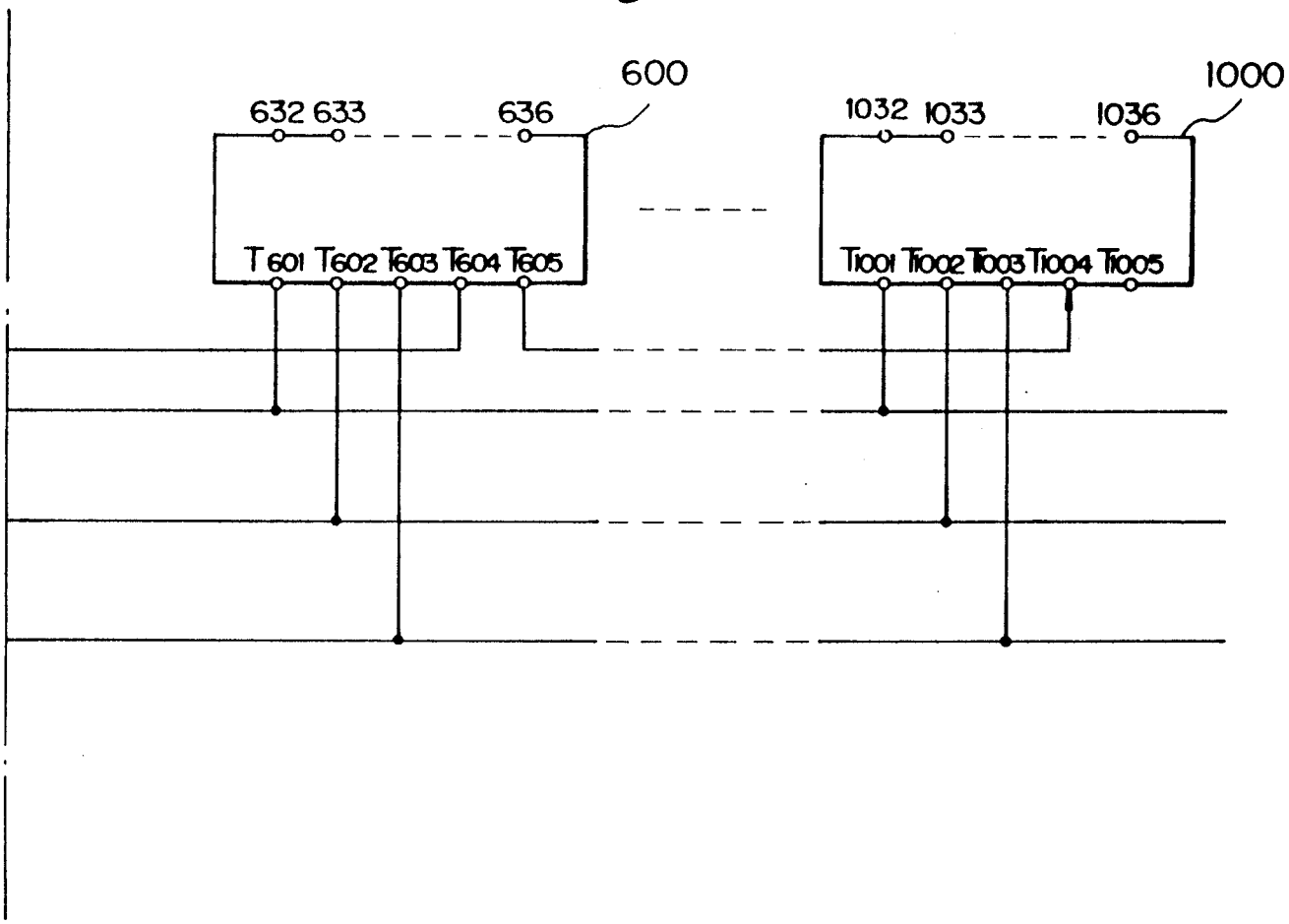

FIGS. 1A and 1B is a diagram showing the cascade-connection relationship of a plurality of LCD driver circuits.

Referring to FIGS. 1A and 1B, data Ds serially transmitted from a data generating circuit 10 is supplied to each of an input terminal $T_{101}$ of a first LCD driver circuit 100 and an input terminal $T_{201}$ of a second LCD driver circuit 200. The LCD drivers 200, 500, 600 and 1000 have the same circuit configuration as that of the first LCD driver 100. A clock pulse signal CP from a clock pulse generator 20 input in synchronism with the data Ds is supplied to each of input terminals $T_{102}$ and $T_{202}$ of the first and second LCD drivers 100, 200 and subsequent LCD drivers. In addition, a latch pulse signal LP from a latch pulse generating circuit 30 used to latch the data Ds is supplied to each of input terminals $T_{103}$ and $T_{203}$ of the first and second LCD drivers 100, 200 and the subsequent LCD drivers.

An enable signal is output from an output terminal $T_{105}$ of the first LCD driver 100 so as to be delivered to an input terminal $T_{204}$ of the second LCD driver 200. Incidentally, the input terminal $T_{104}$ is connected to ground (or to an "L" level source).

Figure 2A:
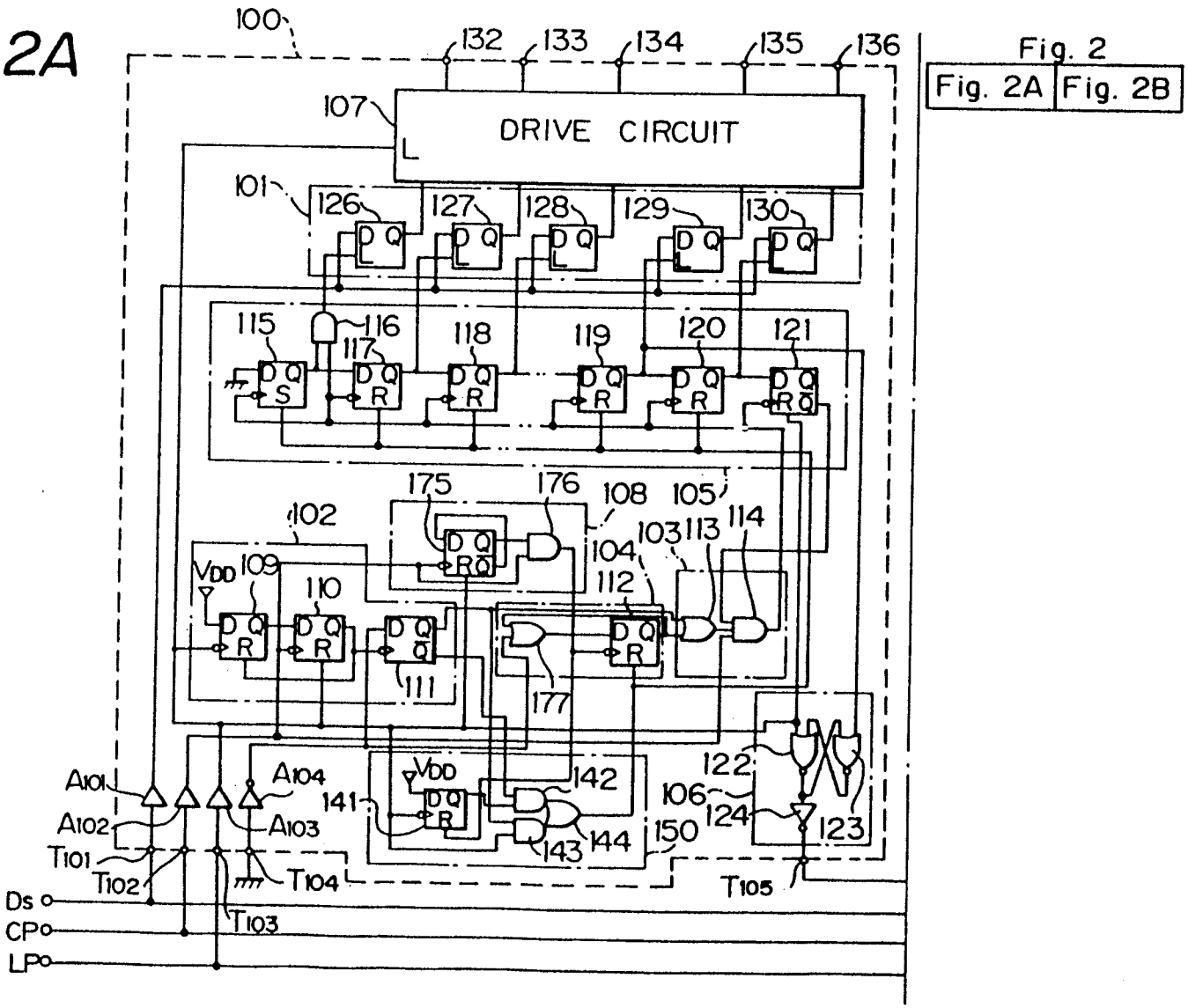
Figure 2B:
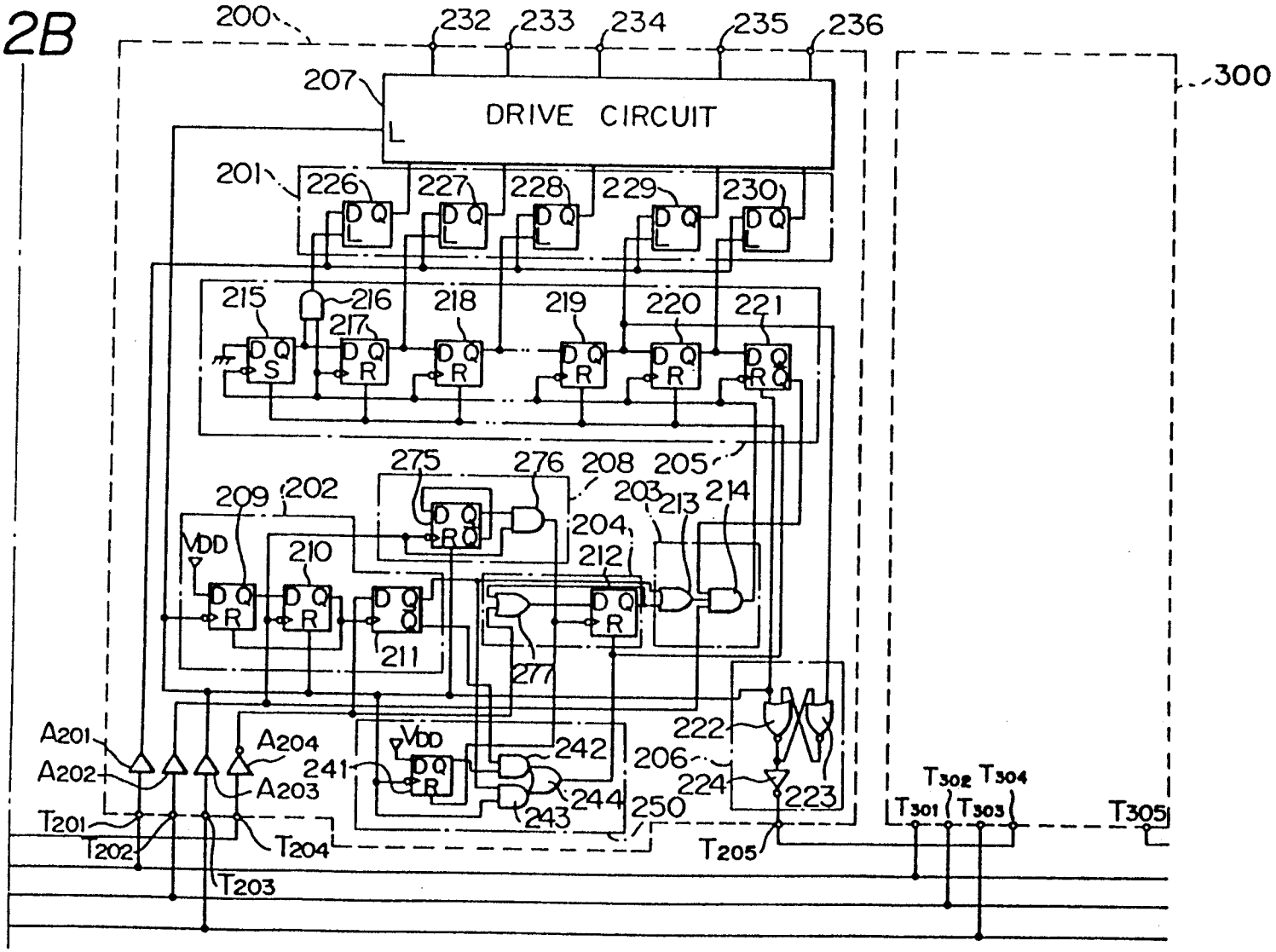

FIGS. 2A and 2B show a detailed circuit configuration of the LCD driver circuits. As the LCD drivers have the same circuit configuration, the description of the first LCD driver 100 also applies to the other LCD drivers.

The data Ds supplied to the input terminal $T_{101}$ is supplied via a buffer $A_{101}$ to each of D (data) input terminals of a plurality of flip-flops 126 to 130 of a data latch circuit 101. Flip-flop 127 to 130 maybe either data flip-flops (D-F/Fs) or data latches (D-latches). However, a data flip-flop must be used for the flip-flop 126. On the other hand, the latch pulse LP delivered to the input terminal $T_{103}$ is supplied via a buffer $A_{103}$ to each of a determining circuit 102, a counter circuit 108, an enable signal output circuit 106, a drive circuit 107 and a latch pulse control circuit 150. The latch pulse control circuit 150 comprises a flip-flop 141, two-input AND gates 142, 143 and an OR gate 144. The latch pulse LP is supplied to a clock input terminal of the flip-flop 141 and a first input terminal of the two-input AND gate 143. The clock pulse CP supplied to the input terminal $T_{102}$ is supplied via a buffer $A_{102}$ to each of the determining circuit 102, the counter circuit 108 and a clock control circuit 103.

The determining circuit 102 comprises flip-flops (hereinafter abbreviated as "FFs") 109, 110, 111. The FF109 has a data input terminal electrically connected to a $V_{DD}$ (or to an "H" level source) and a clock input terminal supplied with the latch pulse signal LP. The Q output of the FF109 is electrically connected to a data input terminal of the FF110, which has a clock input terminal supplied with the clock pulse CP, a R (reset) input terminal supplied with the latch pulse LP and a Q output electrically connected to a R input terminal of the FF109 and a clock input terminal of the FF111. A D (data) input terminal of the FF111 is supplied with an enable signal (an "H" level obtained by inverting an "L" level at the input terminal $T_{104}$ with an inverter $A_{104}$). Incidentally, the Q output of the FF111 is "H" in level when the first LCD driver 100 is used, whereas the Q output thereof is "L" in level when the second LCD driver 200 is used, thus producing a clock control signal. When dedicated PINs are used for an IC, either a signal of an "H" level or a signal of an "L" level may directly be input from the outside of the IC as an input signal without using the determining circuit 102. In addition, the counter circuit 108 comprises an FF175 and an AND gate 176. The FF175 is operated as a T-flip-flop (hereinafter abbreviated as a "T-FF") by electrically connecting the $\overline{Q}$ (represented by placing a bar over the term Q) output terminal (hereinafter referred to as a "bar Q output terminal") of the FF175 to a D (data) input terminal thereof. In addition, the FF175 has a clock input terminal supplied with the clock pulse CP, and is triggered on the trailing edge of the clock pulse CP. The Q output terminal of the FF175 is electrically connected to a first input terminal of the AND gate 176 whose second input terminal is supplied with the clock pulse CP. The output terminal of the AND gate 176 is electrically connected to a clock input terminal of an FF112 of an enable latch circuit 104 and a R input terminal of the FF141 of the latch pulse control circuit 150. The FF112 has a D input terminal supplied with the enable signal referred to above. The Q output of the FF111 is electrically connected to a first input terminal of an OR gate 113 of the clock control circuit 103 and a second input terminal of the AN gate 143 of the latch pulse control circuit 150. The bar Q output terminal of the FF111 is electrically connected to a first input terminal of the AND gate 142 of the latch pulse control circuit 150. A D input terminal of the FF141 is electrically connected to the $V_{DD}$, whereas the Q output thereof is electrically connected to a second input terminal of the AND gate 142. The output terminal of the AND gate 142 is electrically connected to a first input terminal of an OR gate 144, whereas the output terminal of the AND gate 143 is electrically connected to a second input terminal of the OR gate 144. The output of the OR gate 144 is electrically connected to each of a R input terminal of the FF112 of the enable latch circuit 104, an S input terminal of an FF115 of a shift register or address designation circuit 105 and reset terminals R of FF117 to FF121. The FF115 are electrically connected to one another in such a manner that a signal output from the Q output terminal of the previous flip-flop is supplied in turn to a D (data) input terminal of the next flip-flop. Incidentally, the data input terminal of the FF115 as the first stage is connected to ground. The Q outputs of the FF117 to FF120 are supplied to L input terminals of FF127 to FF130, respectively, of the data latch circuit 101 (the FF127 to FF130 may be data flip-flops which are triggered on the falling or trailing edge of the input pulse). In addition, the Q output of the FF115 of the shift register 105 is electrically connected to a first input terminal of an AND gate 116 whose output terminal is electrically connected to the L input terminal of the FF126. A first input terminal of an OR gate 177 of the enable latch circuit 104 is supplied with the enable signal fed through the inverter $A_{104}$ and the output of the OR gate 177 is electrically connected to the D input terminal of the FF112. The Q output of the FF112 is electrically connected to a second input terminal of the OR gate 177 and a second input terminal of the OR gate 113 of the clock control circuit 103. The OR gate 177 is not necessarily needed in the present invention. Even if the OR gate 177 is not provided, the present LCD driver circuit can be activated. It is however preferable to provide the OR gate 177 in order to ensure the accuracy of the operation of the LCD driver circuit. The output of the OR gate 113 is electrically connected to a second input terminal of an AND gate 114 whose first input terminal is electrically connected to the bar Q output of the FF121. The clock pulse signal CP as the output of the buffer $A_{102}$ is supplied to a third input terminal of the AND gate 114 of the clock control circuit 103. In addition, the output terminal of the AND gate 114 is electrically connected to each of the clock input terminals of the FF115, FF117 to FF121 and a second input terminal of the AND gate 116.

The enable output circuit 106 comprises two-input NORs 122, 123 and an inverter 124. The NOR 122 has a first input terminal supplied with the latch pulse signal LP and a second input terminal to which an output terminal of the NOR 123 is electrically connected. The output terminal of the NOR 122 is electrically connected to a first input terminal of the NOR 123 and coupled via the inverter 124 to the enable output terminal $T_{105}$. A second input terminal of the NOR 123 is electrically connected to the Q output terminal of the FF119.

Then, a clock input terminal L of the drive circuit (may include the latches therein) 107 is supplied with the latch pulse LP. In addition, the outputs produced from the respective Q outputs of the FF126 to FF130 of the data latch or serial-parallel conversion circuit 101 are supplied via the drive circuit 107 to respectively corresponding output terminals 132 to 136.

Figures 3, 3A:
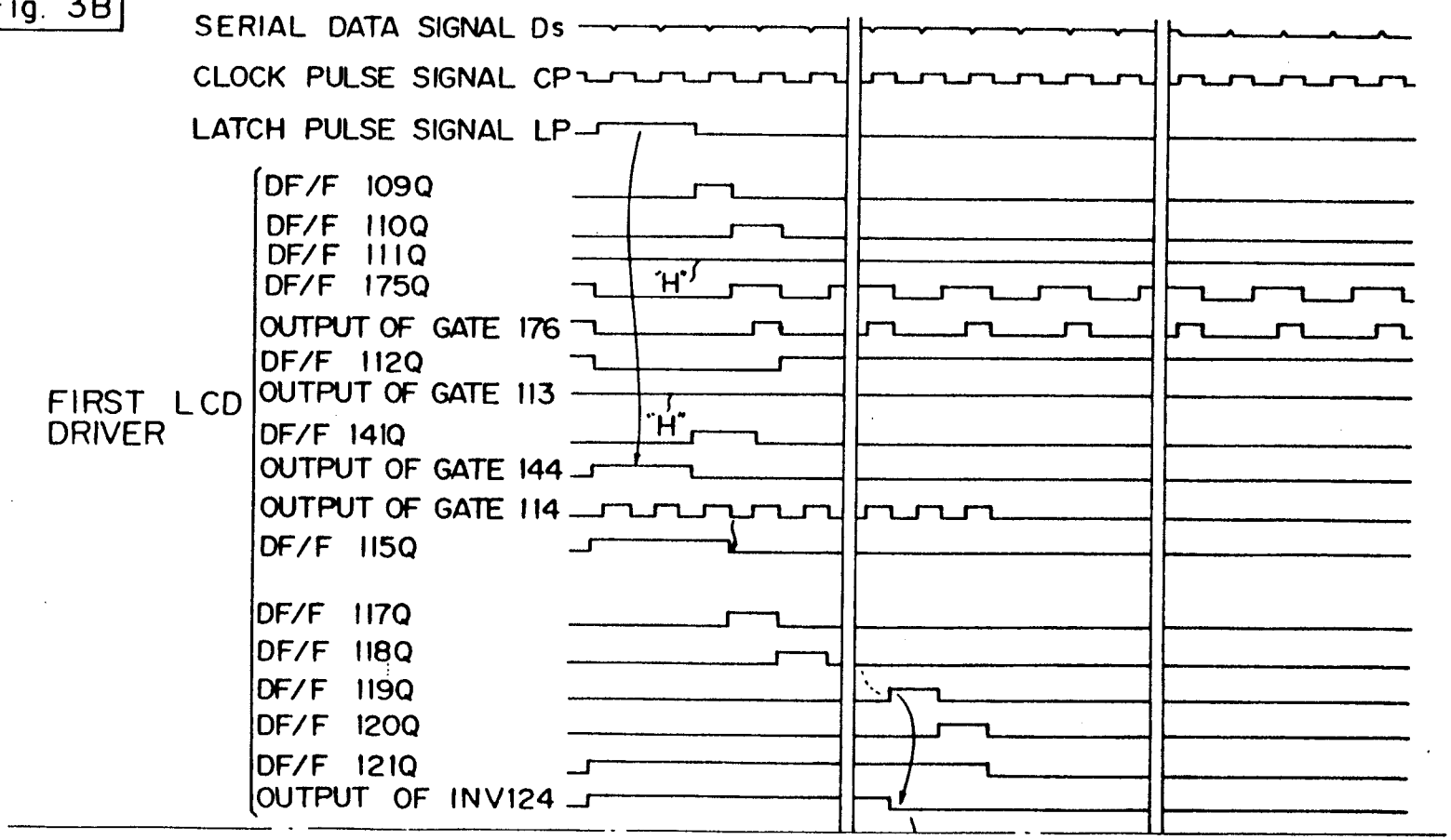
FIGS. 3, 3A and 3B comprise a timing chart showing the operation of the LCD driver shown in FIG. 2.
Figure 3B:
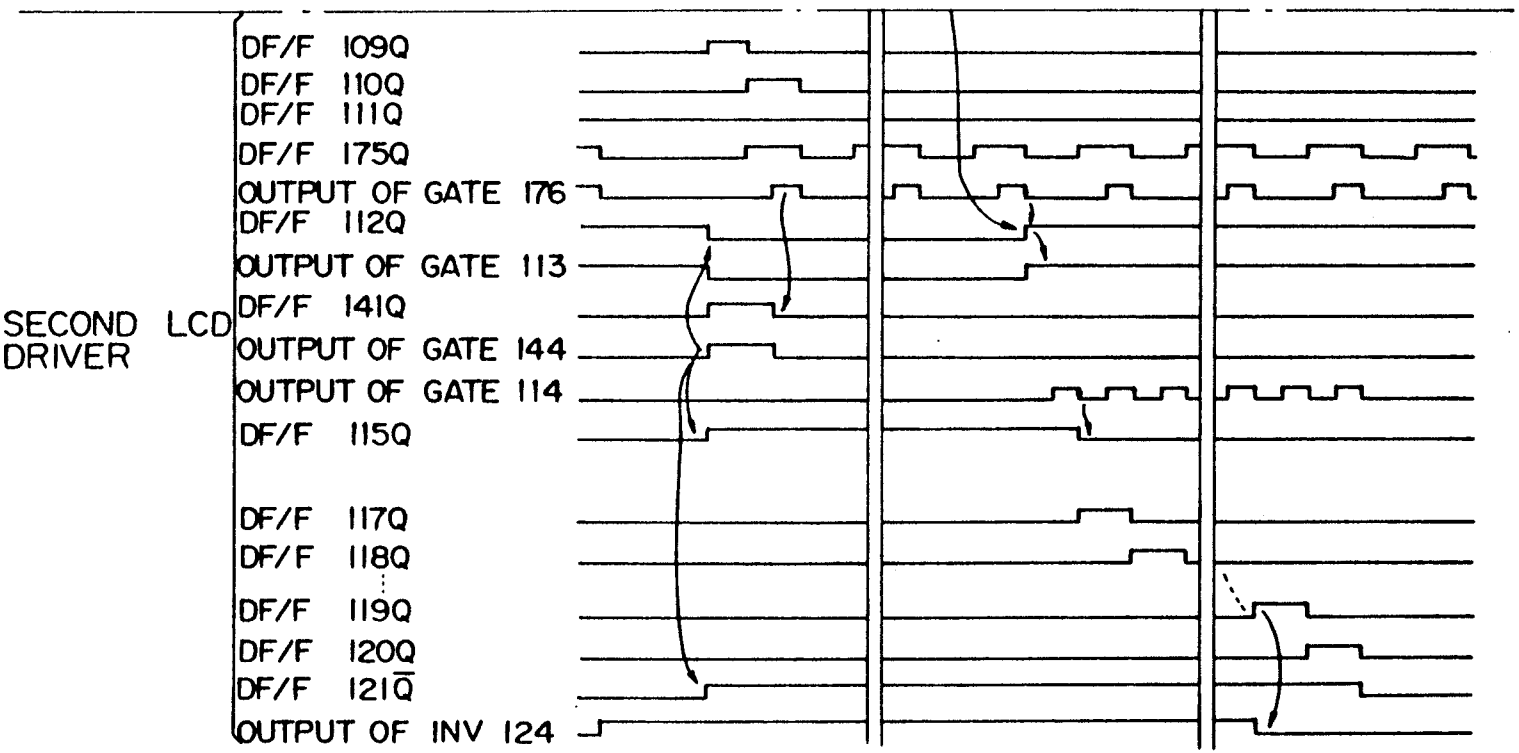

A description will now be made of the operation of each of the cascade-connected LCD drivers with reference to a timing chart shown in FIGS. 3A and 3B. The serial data Ds, the clock pulse signal CP and the latch pulse signal LP are represented in the form of waveforms illustrated in FIG. 3, each of which is a complete continuity of states.

First of all, the determining circuit 102 is activated to receive the enable signal at the D input terminal of the FF111 on the trailing (or falling) edge of a 2nd clock of the clock pulse CP after the latch pulse LP has fallen. As a result, the determining circuit 102 receives the "H" level signal (the enable signal), and outputs it from the Q output of the FF111.

On the other hand, the NORs 122, 123 of the enable signal output circuit 106 form an S-R flip-flop, which is reset by the "H" level signal of the latch pulse LP. The output signal of the S-R flip-flop is rendered "H" in level via the inverter 124 and is applied to the second LCD driver 200 as an enable signal. Thus, the FF211 of the second LCD driver 200 reads or takes in an "L" level signal inverted by the inverter $A_{204}$ and outputs the "L" level signal from the Q output thereof. As a result, it is determined that the first LCD driver 100 has been brought to an "H" level state and the second LCD driver 200 has been brought to the "L" level state. Since the Q output of the FF111 is maintained at the "H" level, the output of the OR gate 113 is fixed to the "H" level. Since the Q output of the FF211 is maintained at the "L" level, the output of the OR gate 213 is determined based on the Q output of the FF212. The counter circuit 108 is reset by the latch pulse LP and activated in such a manner as to cause only every even-numbered pulse of the subsequently-input clock pulses CP to pass therethrough. The FF112 of the enable latch circuit 104 reads an "H" level signal on the trailing edge of the even-numbered clock pulse referred to above when the first LCD driver 100 is used, and delivers the read signal to the second input terminal of the OR gate 113. Similarly, the FF212 reads or takes in the "L" level signal on the trailing edge thereof when the second LCD driver 200 is used, and feeds the read signal to the second input terminal of the OR gate 213. Thus, the two inputs of the OR gate 213 are both the L levels and hence the output of the OR gate 213 is brought to the "L" level. Accordingly, the output of the AND gate 214 is also fixed to the "L" level. The latch pulse control circuits 150 and 250 are triggered on the trailing edge of the latch pulse. Each of the pulse control circuits 150 and 250 comprises the FF141 (or FF241) reset by the output of the AND gate 176 (or 276) of the counter circuit 108 (or 208), the two-input AND gates 142, 143 (or 242, 243) used to select either one of the Q output of the FF141 (or FF241) and the latch pulse LP, and the two-input OR gate 144 (or 244) having two inputs connected to the outputs of the FF142 and FF143 (or FF242 and FF243). The Q output of the FF111 of the determining circuit 102 is maintained at the "H" level as described above. Thus, the latch pulse LP passes through the OR gate 144 via the AND gate 143.

On the other hand, since the Q output of the FF211 is of the "H" level, a signal output from the Q output of the FF241 of the latch pulse control circuit 250 passes through the OR gate 244 via the AND gate 242. Since the D input terminal of the FF241 of the latch pulse control circuit 250 is electrically connected to the "H" level, the FF241 is triggered on the trailing edge of the latch pulse, after which it is reset by the signal output from the AND gate 276 of the counter circuit 208.

The latch pulse signal LP which passes through the OR gate 144 via the AND gate 143 is transmitted to the R (reset) input terminal of the FF112 of the enable latch circuit 104, the S (set) input terminal of the FF115 and the R input terminals of the FF117 to FF121 of the shift register 105. Accordingly, the enable latch circuit 104 and the FF115 and the FF117 to FF121 of the shift register 105 are initially set to the "H" level of the latch pulse LP. The bar Q output terminal of the FF121 of the shift register 105 is brought to an "H" level, which is, in turn, sent to the first input terminal of the AND gate 114 of the clock control circuit 103. Since the second input terminal of the AND gate 114 is of the "H" level as described above, the clock pulse CP fed from the data generating circuit passes through the AND gate 114 via the buffer $A_{102}$ so as to be input to each of the clock input terminals of the FF115 to FF121 of the shift register 105. Since the bar Q output of the FF211 of the determining circuit 202 is of an "H" level in the second LCD driver 200, the Q output which is the inverted bar Q output is brought to the "L" level so that the AND gate 243 prevents the signal on the second input terminal from passing therethrough. Therefore, the Q output of the FF241 of the latch pulse control circuit 250 passes through to the R input terminal of the FF212 of the enable latch circuit 204, the S input terminal of the FF215 and the R input terminals of the FF217 to FF221 of the shift register 205.

The Q output of the FF141 of the latch pulse control circuit 150 is maintained at the "H" level during a period between the trailing edge of the latch pulse LP and the first rising edge of the output signal from the AND gate 176 of the counter circuit 108 as described above. The FF112 of the enable latch circuit 104 is reset by the "H" level signal of the Q output of the FF141. As a result, the Q output of the FF112 is set to the "L" level, and the Q output of the FF115 of the shift register 105 is set to the "H" level. In addition, the Q output of each of the FF117 to FF120 is brought to the "L" level and the bar Q output of the FF121 is brought to the "H" level.

The "H" level signal of the bar Q output of the FF121 is applied to the first input terminal of the AND gate 114 of the clock control circuit 103 and the second input terminal of the AND gate 114 is of the "L" level as described above. Since the second input terminal of the AND gate 114 is held at the "L" level, the output of the AND gate 114 is fixed to the "L" level. Therefore, the AND gate 114 serves to inhibit the clock pulse CP from passing therethrough.

Then, the serial data Ds input in synchronism with the clock pulse signal CP are supplied via the buffer $A_{101}$ to each of the D input terminals of the FF126 to FF130 of the data latch circuit 101. Since the D input terminal of the FF115 is connected to ground, the bar Q output of the FF121 is of the "H" level. At this time, the clock pulse signal CP passes through the AND gate 114 of the clock control circuit 103 so as to send the clock pulse CP to the clock input terminal of each of the FF115, FF117 to FF121. However, since the FF115 has been initially set by the "H" level of the latch pulse signal LP, the clock pulse CP input to the FF115 is invalidated. Then, when the latch pulse falls, the data which has been held in the drive circuit 107 is latched. When the initial clock pulse of the clock pulse signal CP is input into the FF115 after the latch pulse LP has fallen, the FF115 reads or takes in the "L" level on the trailing edge of the input clock pulse signal CP and outputs the "L" level signal from the Q output thereof. Therefore, the FF126 of the data latch circuit 101 reads, in response to the trailing-edge of the "L" level signal, the serial data Ds input to the D input terminal thereof, which has been synchronized with the clock pulse signal CP. Thereafter, the serial data Ds read in the data latch circuit 101 is sent to the drive circuit 107. Further, the FF117 reads or takes in the "H" level signal input to the D input terminal thereof on the trailing edge of the clock pulse, and outputs it from the Q output thereof. Then, a second clock pulse of the clock pulse signal CP input after the trailing edge of the input latch pulse LP passes through the AND gate 114 so as to be transferred to the shift register 105 in the same manner as described above (the signal output from the AND gate 114 will hereinafter be referred to as a "shift clock pulse"). Thereafter, the FF117 reads the "L" level on the trailing edge of the shift clock pulse so as to set the Q output thereof to the "L" level. In addition, the FF118 reads the "H" level so as to set the Q output thereof to the "H" level.

As a result, the FF117 can supply the "H" level from the Q output thereof.

Then, the FF127 reads the serial data Ds input in synchronism with the clock pulse signal CP and sends the data Ds to the drive circuit 107 from the Q output thereof. Likewise, when a third clock pulse signal CP is input after the trailing edge of the latch pulse LP has appeared, the FF128 reads the serial data Ds in response to a signal supplied from the Q output of the FF118 and sends it to the drive circuit 107. When the third data of the serial data Ds to be fed to the first LCD driver 100 as seen from the last data is sent to the drive circuit 107 after a series of operations referred to above have been performed, the Q output of the FF119 is brought to the "H" level. Consequently, a signal of the "H" level output from the Q output of the FF119 is supplied to the S-R flip-flop of the enable signal output circuit 106, which is in turn set to the "H" level. This "H" level signal is brought to the "L" level by the inverter 124 which outputs it from the output terminal $T_{105}$ as the enable signal. The enable signal is input to the enable signal input terminal $T_{204}$ of the second LCD driver 200 so as to be sent via an inverter $A_{204}$ to the data input terminal of the FF211 and via the OR gate 277 of the enable latch circuit 204 to the data input terminal of the FF212. At this time, the clock pulse is input to the clock input terminal of the FF112. However, a time delay occurs in the transmission of the enable signal by the AND gate 114, the FF119, the NOR gates 122, 123 and the inverter 124 in the first LCD driver 100. In addition, such a change or transition cannot be read or determined.

When a second clock pulse of the clock pulse signal to be fed to the first LCD driver 100 as seen from the last pulse is input, the Q output terminal of the FF119 is brought to the "L" level, and the Q output terminal of the FF121 is "H" in level. Thus, the FF129 reads the second data of the serial data Ds to be fed to the first LCD driver 100 as seen from the last data and sends the read data to the drive circuit 107. Since the AND gate 276 in the second LCD driver 200 does not produce an output at this time, the FF212 does not read or take in the "H" level signal from the data input terminal thereof. Thus, the second input terminal of the AND gate 214 is held at the "L" level, so that the clock pulse signal CP is inhibited from passing through the AND gate 214. When the last clock pulse of the clock pulse signal CP to be fed to the first LCD driver 100 is input, the Q output terminal of the FF120 is brought to the "L" level and the Q output terminal of the FF121 is brought to the "H" level.

In addition, the bar Q output terminal of the FF121 reaches the "L" level. Accordingly, the FF130 reads the last serial data Ds to be fed to the first LCD driver 100 and sends it to the drive circuit 107. The "L" level signal from the bar Q output of the FF121 is applied to the first input terminal of the AND gate 114 so as to fix the output of the AND gate 114 to the "L" level.

Thus, the first LCD driver 100 takes in only the serial data for the first LCD driver 100 fed from the data generating circuit 10. When the serial data for the first LCD driver 100 are all input to the first LCD driver 100, the clock pulse signal CP is immediately inhibited from being input thereto. In the second LCD driver 200, on the other hand, the FF212 reads or takes in the "H" level signal input to the data input terminal thereof via the OR gate 277 at the trailing edge of the last clock pulse of the clock pulse signal CP input to the first LCD driver 100. Thereafter, the FF212 outputs the read "H" level signal from the Q output terminal thereof. This output signal is input to the second input terminal of the OR gate 277 whose output is sent to the D input terminal of the FF212. Once the Q output of the FF212 is brought to the "H" level, the Q output thereof is subsequently held at the "H" level until a reset input signal is input to the R input terminal of the FF212. Further, the Q output of the FF212 is sent to the second input terminal of the OR gate 213. Therefore, the output of the OR gate 213 is brought to an "H" level after which it is supplied to the second input terminal of the AND gate 214. The first input terminal of the AND gate 214 has been supplied with the bar Q output of the FF221 and has already been initialized by the latch pulse signal LP. Thus, the first input terminal of the AND gate 214 is now held at the "H" level, thereby releasing present inhibition of the input of the clock pulse CP to the AND gate 214.

Accordingly, a clock pulse of the clock pulse signal CP (an initial clock pulse input to the second LCD driver 200, which will hereinafter be called a "first pulse ") input to the second LCD driver 200 after the clock pulses of the clock pulse signal CP have completely been sent to the first LCD driver 100, is sent via the AND gate 214 to each of the clock input terminals of the FF215 and FF217 to FF221. Then, serial data firstly input to the second LCD driver 200 is fed to the D input terminal of the FF226. Therefore, the FF215 reads or takes in the "L" level signal in response to the first clock pulse of the clock pulse signal CP input to the second LCD driver 200 so as to set the Q output thereof to the "L" level. Then, the FF226 reads the serial data Ds from the D input terminal thereof in response to the trailing-edge or last transition signal of the "L" level of the Q output of the FF215 and sends it to the drive circuit 207. Further, the FF217 reads an "H" level signal so as to set the Q output thereof toe the "H" level.

The clock pulse signal CP and the serial data Ds successively fed from the data generating circuit 10 are brought into the FF227 to FF230, respectively, in the second LCD driver 200 in the same manner as the first LCD driver 100. Further, after the third serial data as seen from the last data that has been transmitted is sent to the second LCD driver 200, the S-R flip-flop of the enable output circuit 106 is set. Thus, the enable signal is brought to an "L" level by the inverter 224 and it is sent to a third LCD driver 300. After the last serial data has been transmitted to the second LCD driver 200, the bar Q output of the FF221 is brought to the "L" level so as to fix the output of the AND gate 214 to the "L" level, thereby prohibiting the clock pulse signal CP from being input to the AND gate 214. The subsequent LCD drivers such as the third, fourth, ... are also activated in the same manner as described above. That is, after the last serial data have been sent to the subsequent LCD drivers respectively, the latch pulse signal LP is input to each of the LCD drivers. Then, the latch pulse signal LP is applied to each of the clock pulse input terminals of the drive circuits 107, 207, ... of all the drivers (such as the first LCD driver 100, the second LCD driver 200, ...). Thereafter, each of data signals output from the FFs126, 226, ... to FFs130, 230, ... is latched in each of the drive circuits 107, 207, ... on the trailing edge of the applied latch pulse, followed by delivering to each of the output terminals 132, 232, ... to 136, 236, ..., thereby finishing one complete cycle.

According to the present invention, as has been described above, each of the first and second LCD drivers 100, 200 is initially set by the "H" level of the latch pulse signal LP thereby to cause each of the drive circuits 107, 207 to latch data output from each of the data latch circuits 101, 201 when the latch pulse falls. That is, the serial data Ds is converted into parallel data on the falling edge of the latch pulse, which is, in turn, output from each of the output terminals 132, 232 to 136, 236 of the drive circuit 107, 207. After the latch pulse has fallen, the first LCD driver 100 starts to accept the serial data Ds and the clock pulse CP corresponding to the next line. Then, when the transfer of the corresponding serial data to the first LCD driver 100 has been completed, the serial data Ds is transferred to the second LCD driver 200. The subsequent LCD drivers successively accept the serial data Ds and the clock pulse signal CP. When the transfer of the corresponding serial data to the last LCD driver of the cascade-connected LCD drivers is completed, the first and second LCD drivers 100, 200 are initialized by the "H" level of the latch pulse as described above and subsequently activated in the same manner as described above. In this embodiment, the first LCD driver 100 makes use of the "H" level itself of the latch pulse signal LP for the purpose of initialization. It is however unnecessary to activate the first LCD driver 100 during a period in which the "H" level of the latch pulse signal LP continues. If the first LCD driver 100 starts to accept the serial data Ds and the clock pulse signal CP after the latch pulse signal LP has fallen, and terminates its operation as described above, then it is unnecessary for the first LCD driver 100 to operate during a period other than the "H" level period referred to above. Then, the second LCD driver 200 starts to receive the serial data Ds and the clock pulse signal CP in response to the enable signal output of the "L" level, which is fed from the output terminal $T_{105}$ of the first LCD driver 100. It is however necessary that the second LCD driver 200 starts to successively accept the serial data Ds and the clock pulse signal CP in response to the enable signal output from the previous stage. Therefore, the second LCD driver 200 cannot make use of the "H" level, itself, of the latch pulse LP as in the first LCD driver 100. Accordingly, a signal (hereinafter called a "latch pulse signal LP1") having the "H" level only during a period in which the signal output from the AND gate 176 of the counter circuit 108 rises from the time when the latch pulse has fallen, is sent to each of the enable latch circuit 204 and the shift register 205 so as to initialize the enable latch circuit 204 and the shift register 205. Then, the latch pulse signal LP itself is input to the determining circuit 202, the counter circuit 208, the enable signal output circuit 206 other than the enable latch circuit 204 and the shift register 205. This is because the determining circuit 202, the counter circuit 208 and the enable signal output circuit 206 are required for synchronization purposes of the entire LCD drivers cascade-connected to one another.

Then, the pulse width of the latch pulse LP is determined by a period N times the period of the clock pulse signal CP. This "N" varies with the number of outputs to be used in the drive circuit and the number of data inputs employed therein. When the serial data fed from the data generating circuit is 4BIT at the time that the number of the outputs to be used is 80, for example, the number of necessary clocks (corresponding to the number of bits in the shift register 105) is 20 (=80+4). When the data are input in serial form, the number of the clocks becomes 80. The "N" is the left number that the number of the necessary clocks minus one. If the serial data is 4BIT, then N is equal to 19 (i.e., N=19). If the data is handled serially, then N is equal to 79 (i.e., N=79).

As described above, the pulse width of the latch pulse signal LP can be widened because it is unnecessary that the last LCD driver of the cascade-connected LCD drivers sends the enable signal to the next LCD driver and the last LCD driver may simply be activated to receive the enable signal fed from the previous LCD driver. Thus, the latch pulse control circuit 150 can select either one of the latch pulse signal LP itself and the latch pulse signal LPI referred to above based on the result of determination by the determining circuit 102. In addition, the enable signal firstly set by the OR gate 177 of the enable latch circuit 104 is held in order to prohibit to clear it by the latch pulse signal LP. As a result, the pulse width of the latch pulse LP can be widened as described above. A conventional LCD driver is activated by the level of the latch pulse signal. However, the LCD driver of the present invention is activated in response to the trailing edge of the latch pulse even if the clock pulse signal CP is input into the LCD driver in confronting relation during a period in which the latch pulse is in "H" level. Therefore, restrictions on the pulse width of the latch pulse LP are relaxed, thereby making it possible to interface with the data generating circuit over a wide range.

Figure 4:
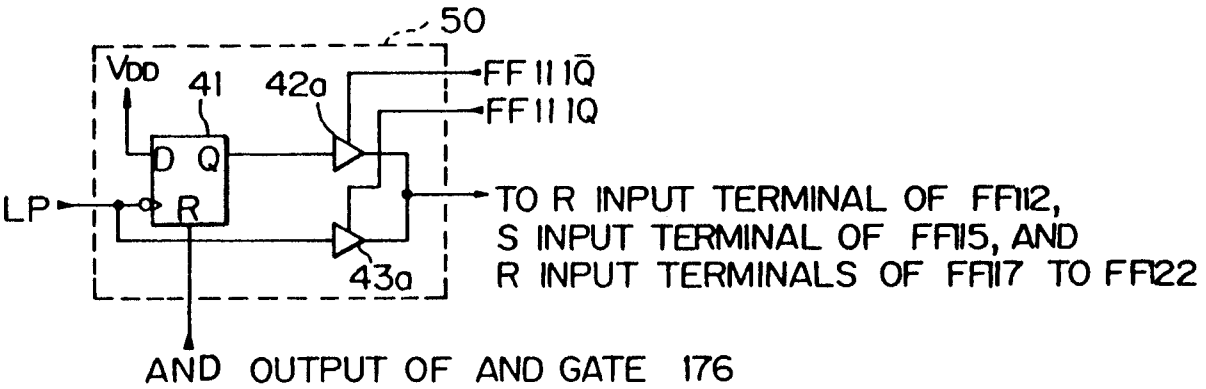
FIG. 4 is a partial circuit diagram depicting a latch pulse control circuit of an LCD driver employed in a second embodiment of the present invention.

In the present embodiment, the latch pulse control circuit 150 comprises the FF141, the AND gates 142, 143, and the OR gate 144. However, the same effect as that of the above latch pulse control circuit 150 can be brought about even when FF41 and tristate buffers 42*a*, 43*a* are used as an alternative to these components. This latch pulse control circuit 50 is illustrated in FIG. 4 by way of example. FIG. 4 is a partial circuit diagram showing the latch pulse control circuit 50 which is an alternative to the latch pulse control circuit 150 of the first LCD driver 100 shown in FIG. 2A and which is employed in an LCD driver of a second embodiment. Other elements of the structure in the LCD driver of the second embodiment are identical to those employed in the first LCD driver 100 of FIG. 2A, which is used in the first embodiment, and their description will therefore be omitted. A latch pulse signal LP shown in FIG. 4 is supplied to the clock input terminal of the FF41 of the latch pulse control circuit 50 and the input of the tristate buffer 43*a*. In addition, the Q output of the FF41 is electrically connected to the input of the tristate buffer 42*a*. The R input terminal of the FF41 is electrically connected to the output of the AND gate 176 of the counter circuit 108. The output of the tristate buffer 42*a* is electrically connected to the output of the tristate buffer 43*a*. Further, the output of the tristate buffer 42*a* is also electrically connected to the R input terminal of the FF112 of the enable latch circuit 104, the S input terminal of the FF115 and the R input terminal of each of the FF117 to FF121. A control input terminal of the tristate buffer 42*a* is electrically connected to the bar Q output of the FF111 of the determining circuit 102. A control input terminal of the tristate buffer 43*a* is electrically connected to the Q output of the FF111 of the determining circuit 102. When the control input terminal of each of the tristate buffers 42*a*, 43*a* is subjected to the "H" level, an input signal of the "H" level is sent to the output of each of the tristate buffers 42*a*, 43*a*. When each control input terminal is of the "L" level, the output of each of the tristate buffers 42*a*, 43*a* is brought to a high impedance. The latch pulse control circuit 50 selects, as an output signal, either one of the latch pulse signal LP itself and the output signal from the Q output of the FF41 in response to the outputs from the Q output of the FF111 of the determining circuit 102 and the bar Q output thereof. It is apparent that a result identical to that obtained by the first LCD driver 100 shown in FIG. 2 can subsequently be obtained.

Figure 5:
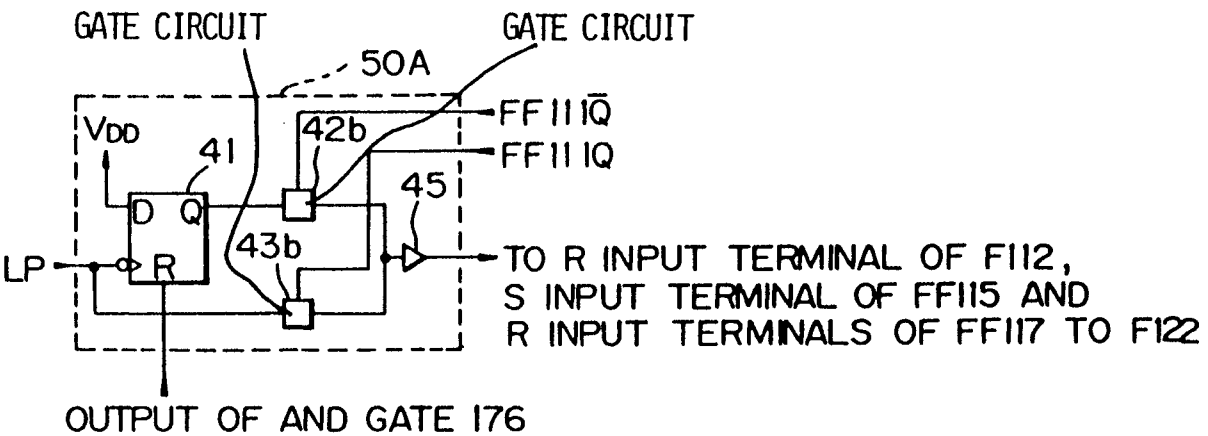
FIG. 5 is a partial circuit diagram showing a latch pulse control circuit of an LCD driver employed in a third embodiment of the present invention.

FIG. 5 is a partial circuit diagram showing the latch pulse control circuit 50A which is alternative circuit of the latch pulse control circuit 150 of the first LCD driver shown in FIG. 2A, and employed in an LCD driver of a third embodiment. Other elements of structure in the LCD driver of the third embodiment are identical to those employed in the first LCD driver 100 of FIG. 2A, which is used in the first embodiment, and their description will therefore be omitted.

A latch pulse LP shown in FIG. 5 is supplied to the clock input terminal of the FF41 of the latch pulse control circuit 50A and the input of an analog switch or gate circuit 43*b*. In addition, the Q output of the FF41 is electrically connected to the input of an analog switch or gate circuit 42*b*. The output of the analog switch 42*b* is supplied to desired terminals via a buffer 45. The output of the analog switch 43*b* is delivered via the buffer 45 to the R input terminal of the FF112 of the enable latch circuit 104, the S input terminal of the FF115 and the R input terminal of each of the FF117 to FF121. A control input terminal of the analog switch 42*b* is electrically connected to the bar Q output of the FF111 of the determining circuit 102, whereas a control input terminal of the analog switch 43*b* is electrically connected to the Q output of the FF111 of the determining circuit 102. When each of the control input terminals of the analog switches 42*b*, 43*b* is supplied with the "H" level, an input signal of the "H" level is delivered to the output of each of the analog switches 42*b*, 43*b*. When each control input terminal is supplied with the "L" level, the output of each of the analog switches 42*b*, 43*b* is brought to a high impedance. In addition, the analog switches 42*b*, 43*b* are bidirectional. Therefore, when the output of each of the analog switches 42*b*, 43*b* is used in the form of a wired OR, it is necessary to use a wired OR function via a buffer. To this end, the buffer 45 is used as the buffer in the first embodiment. The latch pulse control circuit 50A is merely activated to select, as an output signal, either one of the latch pulse signal LP itself and the output from the Q output of the FF141 in response to the outputs from the Q output of the FF111 of the determining circuit 102 and the bar Q output thereof. It is clear that a result identical to that obtained by the first LCD driver 100 shown in FIG. 2A can subsequently be obtained.

Figure 6:
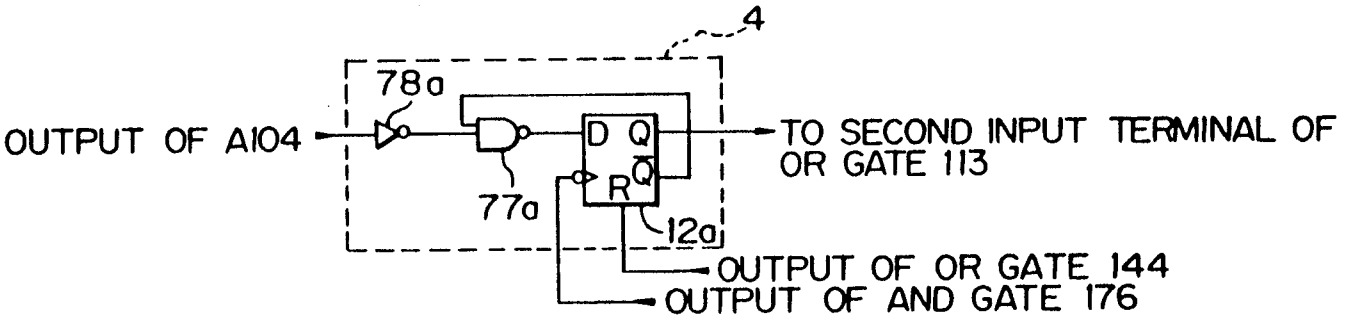
FIG. 6 is a partial circuit diagram illustrating an enable latch circuit of an LCD driver employed in a fourth embodiment of the present invention.

Further, in the present invention, a description has been made of a case in which the enable latch circuit 104 comprises the OR gate 177 and the FF112. However, the same effect as that obtained by an enable latch circuit 4 can be brought about even if the FF, an inverter and a NAND gate are used as an alternative to the OR gate 177 and the FF112. The enable latch circuit 4 comprised of the FF12*a*, the inverter 78*a* and the NAND gate 77*a* is illustrated in FIG. 6 by way of example. FIG. 6 is a partial circuit diagram showing the enable latch circuit 4 which in alternative circuit of the enable latch circuit 104 of the first LCD driver 100 shown in FIG. 2A and which is employed in an LCD driver of a fourth embodiment. Other elements of structure in the LCD driver of the fourth embodiment are identical to those employed in the first LCD driver of FIG. 2A, which is used in the first embodiment, and their description will therefore be omitted.

An enable signal shown in FIG. 6 is supplied to a first input terminal of a NAND gate 77*a* via an inverter 78*a* of the enable latch circuit 4. In addition, the output of the NAND gate 77*a* is electrically connected to a D input terminal of an FF12*a*. The Q output of the FF12*a* is electrically connected to the second input terminal of the OR gate 113 of the clock control circuit 103. The bar Q output of the FF12*a* is electrically connected to a second input terminal of the NAND gate 77*a*. A R input terminal of the FF12*a* is electrically connected to the output of the OR gate 144 of the latch pulse control circuit 150. A clock input terminal of the FF12*a* is electrically connected to the output of the AND gate 176 of the counter circuit 108. Once the Q output of the FF12*a* of the enable latch circuit 4 is set in level, the level of the Q output of the FF12*a* is held as it is until a reset signal is input to the R input terminal of the FF12*a*. It is apparent that the same result as that obtained by the first LCD driver 100 shown in FIG. 2A can subsequently be obtained.

Further, the same effect as that obtained by the enable latch circuit 4 shown in FIG. 6 can be achieved even when an FF12*b*, an AND gate 77*b* and an inverter 78*b* are used as an alternative to the components shown in FIG. 6. An enable latch circuit 4A comprising the FF12*b*, the AND gate 77*b* and the inverter 78*b* is illustrated in FIG. 7 by way of example.

Figure 7:
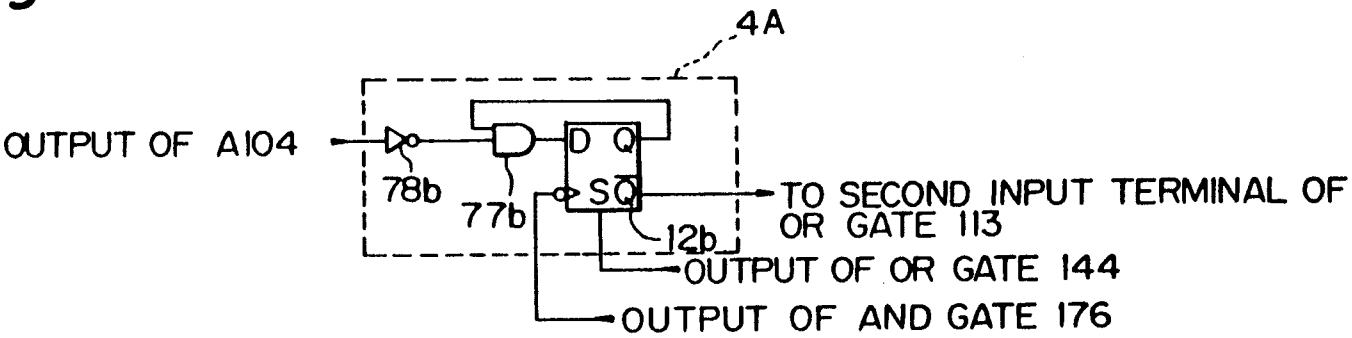
FIG. 7 is a partial circuit diagram showing an enable latch circuit of an LCD driver employed in a fifth embodiment of the present invention.

FIG. 7 is a partial circuit diagram showing the enable latch circuit 4A which is an alternative to the enable latch circuit 104 of the first LCD driver 100 shown in FIG. 2A and which is employed in an LCD driver of a fifth embodiment. Other elements of structure in the LCD driver of the fifth embodiment are identical to those employed in the first LCD driver of FIG. 2A, which is used in the first embodiment, and their description will therefore be omitted.

An enable signal shown in FIG. 7 is supplied to a first input terminal of the AND gate 77*b* via the inverter 78*b* of the enable latch circuit 4A. Further, the output of the AND gate 77*b* is electrically connected to a D input terminal of the FF12*b*. The Q output of the FF12*b* is electrically connected to a second input terminal of the AND gate 77*b*. The bar Q output of the FF12*b* is electrically connected to a second input terminal of the OR gate 113 of the clock control circuit 103. A R input terminal of the FF12*b* is electrically coupled to the output of the OR gate 144 of the latch pulse control circuit 150. A clock input terminal of the FF12*b* is electrically connected to the output of the AND gate 176 of the counter circuit 108 Once the bar Q output of the FF12*b* of the enable latch circuit 4A is set in level, the level of the bar Q output thereof is held as is until a set signal is input to an S input terminal of the FF12*b*. It is apparent that the result similar to that obtained by the first LCD driver shown in FIG. 2A can subsequently be obtained.

Having now fully described the invention, it will be apparent to those skilled in the art that many changes and modifications can be made without departing from the spirit or scope of the invention as set forth herein.

What is claimed is:

1. A driver circuit comprising a plurality of cascade-connected drivers each activated to receive an enable signal, serial data, a clock pulse signal and a latch pulse signal, each of said drivers comprising:

a counter circuit for receiving the clock pulse signal and the latch pulse signal, said counter circuit generating a first control signal in response to the clock pulse signal and the latch pulse signal;

a latch pulse control circuit coupled to said counter circuit for receiving the first control signal and the latch pulse signal, said latch pulse control circuit generating a second control signal in response to the first control signal and the latch pulse signal;

an enable latch circuit coupled to said counter circuit and said latch pulse control circuit for receiving the first and second control signals and a first enable signal, said enable latch circuit generating a third control signal in response to the first and second control signals and the first enable signal;

a lock control circuit coupled to said enable latch circuit for receiving the third control signal, a fourth control signal and the clock pulse signal, said clock control circuit outputting the clock pulse signal in response to the third and fourth control signals;

an address designation circuit coupled to said latch pulse control circuit and said clock control circuit for receiving the second control signal and the clock pulse signal, said address designation circuit generating the fourth control signal and a plurality of fifth control signals in response to the second control signal and the clock pulse signal;

an enable signal output circuit coupled to said address designation circuit for receiving one of the fifth control signals and the latch pulse signal, said enable signal output circuit generating a second enable signal in response to the one of the fifth control signals and the latch pulse signal;

a data latch circuit coupled to said address designation circuit for receiving the fifth control signals and the serial data, said data latch circuit generating a plurality of data signals in response to the fifth control signals and the serial data; and an output circuit coupled to said data latch circuit for outputting drive signals therefrom based on the data signals.

2. A driver circuit according to claim 1, further comprising a determining circuit for receiving the clock pulse signal, the latch pulse signal and the first enable signal therein, said determining circuit generating a sixth control signal in response to the received signals; and wherein said latch pulse control circuit and said clock control circuit receive the sixth control signal.

3. A driver circuit according to claim 1, wherein said counter circuit divides the clock pulse signal, and wherein the first control signal is a divided clock pulse signal.

4. A driver circuit according to claim 1, wherein said address designation circuit comprises a shift register having a plurality of flip flops.

5. A driver circuit according to claim 2, wherein said determining circuit has a first output terminal outputting the sixth control signal and a second output terminal outputting an inverted sixth control signal.

6. A driver circuit according to claim 5, wherein said latch pulse control circuit comprises:

a flip flop having a data input coupled to a power supply, a clock input for receiving the latch pulse signal, a reset input coupled to said counter circuit to receive the first control signal, and a Q output;

a first AND gate having a first input coupled to the second output terminal of said determining circuit, a second input coupled to the Q output of said flip flop, and an output;

a second AND gate having a first input coupled to the first output terminal of said determining circuit, a second input for receiving the latch pulse signal, and an output; and an OR circuit having two inputs coupled to the outputs of said first and second AND gates respectively, and an output for outputting the second control signal.

7. A driver circuit according to claim 5, wherein said latch pulse control circuit comprises:

a flip flop having a data input coupled to a power supply, a clock input for receiving the latch pulse signal, a reset input coupled to said counter circuit to receive the first control signal, and a Q output;

a first tristate buffer having an input coupled to the Q output of said flip flop, a control input coupled to the second output terminal of said determining circuit, and an output;

a second tristate buffer having an input for receiving the latch pulse signal, a control input coupled to the first output terminal of said determining circuit, and an output; and an output terminal commonly coupled to the outputs of said first and second tristate buffers for outputting the second control signals.

8. A driver circuit according to claim 5, wherein said latch pulse control circuit comprises:

a flip flop having a data input coupled to a power supply, a clock input for receiving the latch pulse signal, a reset input coupled to said counter circuit to receive the first control signal, and a Q output;

a first gate circuit having an input coupled to the Q output of said flip flop, a control input coupled to the second output of said determining circuit, and an output;

a second gate circuit having an input for receiving the latch pulse signal, a control input coupled to the first output of said determining circuit, and an output; and a buffer having an input commonly coupled to the outputs of said first and second gate circuits, and an output for outputting the second control signal.

9. A driver circuit according to claim 1, wherein said enable latch circuit comprises:

an OR gate having a first input coupled for receiving the first enable signal, a second input, and an output; and a flip flop having a data input coupled to the output of said OR gate, a clock input coupled to said counter circuit to receive the first control signal, a reset input coupled to the latch pulse control circuit to receive the second control signal, and a Q output coupled to the second input of said OR gate for outputting the third control signal.

10. A driver circuit according to claim 1, wherein said enable latch circuit comprises:

a NAND gate having a first input for receiving the first enable signal, a second input, and an output; and a flip flop having a data input coupled to the output of said NAND gate, a clock input coupled to said counter circuit to receive the first control signal, a reset input coupled to the latch pulse control circuit to receive the second control signal, a bar Q output coupled to the second input of said NAND gate, and a Q output for outputting the third control signal.

11. A driver circuit according to claim 1, wherein said enable latch circuit comprises:

a AND gate having a first input for receiving the first enable signal, a second input, and an output; and a flip flop having a data input coupled to the output of said AND gate, a clock input coupled to said counter circuit to receive the first control signal, a set input coupled to the latch pulse control circuit to receive the second control signal, a Q output coupled to the second input of said AND gate, and a bar Q output for outputting the third control signal.

12. A cascade driver circuit having a plurality of cascade-connected driver circuits connected in common to a serial data line, a latch pulse signal line and a clock pulse signal line, each of the cascade-connected driver circuits comprising:

a counter circuit for frequency-dividing clock pulses received from the clock pulse signal line, said counter circuit generating divided clock pulses;

an enable latch circuit coupled to said counter circuit, said enable latch circuit latching an enable signal received from a preceding cascade-connected driver circuit in response to the divided clock pulses and a latch pulse control signal;

a latch pulse control circuit coupled to the latch pulse signal line, said counter circuit and said enable latch circuit for generating the latch pulse control signal in response to the divided clock pulses and a latch pulse signal received from the latch pulse signal line;

a data latch circuit coupled to said enable latch circuit, said latch pulse control circuit, the clock pulse signal line and the serial data line for latching serial data in response to the clock pulses received from the clock pulse signal line and the latch pulse control signal, said data latch circuit starting to latch serial data when said enable latch circuit receives the enable signal and stopping when said data latch circuit has received a first number of clock pulses; and an enable signal output circuit coupled to said data latch circuit for outputting an enable signal to a next cascade-connected driver circuit when said data latch circuit has received a second number of clock pulses, the second number of clock pulses being at least two less than the first number of clock pulses.

13. A cascade driver circuit according to claim 12, wherein said data latch circuit comprises:

a clock control circuit coupled to said enable latch circuit and the clock pulse signal line for outputting the clock pulse when the enable signal or a first signal is received thereby;

an address designation circuit coupled to said latch pulse control circuit and said clock control circuit for receiving the clock pulses and the latch pulse control signal, said address designation circuit generating a plurality of latching signals and the first signal when said address designation circuit receives the first number of clock pulses; and a serial-parallel conversion circuit coupled to said address designation circuit and the serial data line for outputting parallel data in response to the serial data and the latching signals.

14. A cascade driver circuit according to claim 13, wherein said address designation circuit further generates a second signal when said address designation circuit receives the second number of clock pulses; and said enable signal output circuit outputs the enable signal in response to the second signal.

15. A cascade driver circuit according to claim 13, further comprising a drive circuit coupled to the data latch circuit for outputting driving signals in response to the parallel data.

16. A cascade driver circuit according to claim 13, further comprising a determining circuit for receiving the clock pulses and the enable signal therein, said determining circuit generating a third signal in response to the received signals; and wherein said latch pulse control circuit receives the third signal.

17. A cascade driver circuit having a plurality of cascade-connected driver circuits connected in common to a serial data line providing serial data, a latch pulse signal line providing a latch pulse signal and a clock pulse signal line providing a clock pulse signal, each of the cascade-connected driver circuits comprising:

a control circuit coupled to the latch pulse signal line and the clock pulse signal line for generating a first control signal and a second control signal in response to the clock pulse signal and the latch pulse signal;

a latch pulse control circuit coupled to the latch pulse signal line and said control circuit for outputting a controlled latch pulse signal in response to the first control signal and the latch pulse signal;

a clock control circuit coupled to the clock pulse signal line and said control circuit for outputting a controlled clock pulse signal in response to the second control signal and the clock pulse signal;

a selector circuit coupled to said latch pulse control circuit and said clock pulse control circuit for generating a plurality of select signals in response to the controlled clock pulse signal and the controlled latch pulse signal;

a data latch circuit coupled to the serial data line and said selector circuit for outputting parallel data in response to the select signals and the serial data; and a drive circuit coupled to said data latch circuit for outputting a plurality of drive signals in response to the parallel data.

18. A cascade driver circuit according to claim 17 further comprising an enable signal output circuit coupled to the latch pulse signal line and said selector circuit for generating an enable signal in response to the latch pulse signal and one of the select signals.

19. A cascade driver circuit according to claim 17 further comprising a determining circuit coupled to the latch pulse signal line and said latch pulse control circuit, the determining circuit receiving the latch pulse signal and an enable signal and outputting a determining signal which has a first state and a second state to said latch pulse control circuit in response to the latch pulse signal and the enable signal.

20. A cascade driver circuit according to claim 19 wherein said latch pulse control circuit outputs the latch pulse signal as the controlled latch pulse signal when the determining signal has the first state and outputs a delayed latch pulse signal as the controlled latch pulse signal when the determining signal has the second state.

21. A cascade driver circuit having a plurality of cascade-connected driver circuits coupled for receiving serial data, a latch pulse signal and a clock pulse signal, each of the cascade-connected driver circuits comprising:

a determining circuit for outputting a determining signal which represents whether the driver circuit is a first cascade-connected driver circuit;

a control circuit for receiving the clock pulse signal, said control circuit generating a control signal in response to the clock signal;

a latch pulse control circuit coupled for receiving the control signal, the latch pulse signal and the determining signal, said latch pulse control circuit outputting a controlled latch pulse signal in response to the control signal, the latch pulse signal and the determining signal;

a clock control circuit coupled for receiving the clock pulse signal, the control signal, the determining signal and a stop signal, said clock control circuit outputting the clock pulse signal when the control signal, the determining signal and the stop signal have a predetermined state;

a selector circuit coupled for receiving the clock pulse signal output from said clock control circuit and controlled latch pulse signal, said selector circuit being set in response to the controlled latch pulse signal, outputting a plurality of select signals in response to the clock pulse signal output from said clock control circuit and outputting the stop signal when all of the select signals have been output;

a data latch circuit coupled for receiving the serial data and the select signals, said data latch circuit latching the serial data in response to the select signal and outputting the latched data as parallel data; and a drive circuit coupled to said data latch circuit for outputting a plurality of drive signals in response to the parallel data.

* * * * *